United States Patent [19]

Andres

[11] 4,083,290

[45] Apr. 11, 1978

[54] PNEUMATIC ADJUSTING MECHANISM

[75] Inventor: Rudolf Andres, Sindelfingen, Germany

[73] Assignee: Daimler-Benz Aktiengesellschaft, Germany

[21] Appl. No.: 667,951

[22] Filed: Mar. 18, 1976

[30] Foreign Application Priority Data

Mar. 20, 1975 Germany ..... 2512137

[51] Int. Cl.[2] ..... F15B 9/02; F15B 15/22

[52] U.S. Cl. ..... 91/357; 91/409; 91/470; 92/132; 137/625.11; 137/625.15

[58] Field of Search ..... 91/357, 408, 409, 470, 91/48; 137/625.21, 625.15, 625.11

[56] References Cited

U.S. PATENT DOCUMENTS

| | | | |
|---|---|---|---|
| 2,302,061 | 11/1942 | Schirm | 137/625.11 |
| 2,975,763 | 3/1961 | Grace | 91/357 |
| 3,056,426 | 10/1962 | Houser | 137/625.11 |
| 3,408,899 | 11/1968 | Golden | 91/357 |
| 3,657,966 | 4/1972 | Campbell | 91/357 |

*Primary Examiner*—Paul E. Maslousky
*Attorney, Agent, or Firm*—Craig & Antonelli

[57] ABSTRACT

A pneumatic adjusting mechanism, especially for application in motor vehicles, which consists of a suction-air servo-motor that includes a working cylinder with a diaphragm piston whose piston rod is stressed by a spring against the action of the suction-air; to provide an adjustment to different adjusting path steps, individual control lines are connected to the working cylinder in places which correspond to the adjusting path steps; all control lines lead to a control switch connected with a suction-air reservoir line while each individual control line is adapted to be selectively connected with this suction-air reservoir line, after previous venting of all control lines, by means of the control switch.

19 Claims, 3 Drawing Figures

PNEUMATIC ADJUSTING MECHANISM

The present invention relates to a pneumatic adjusting mechanism, especially for application in motor vehicles, which essentially consists of a suction-air adjusting motor that includes a working cylinder with a diaphragm piston, whose piston rod is stressed by a spring opposite the effect of the suction-air, and of means for the adjustment to different adjusting-path steps.

In numerous applications, predetermined adjusting path steps or regulating distance steps are required for suction-air adjusting motors. In order to achieve such adjusting path steps or regulating distance steps, servovalves, control valves dependent on travel, or the like were used heretofore.

The present invention is concerned with the task to avoid the use of expensive additional aggregates for establishing adjusting path steps or regulating distance steps. The underlying problems are solved according to the present invention in that individual control lines corresponding to the adjusting path or regulating distance steps are connected at the working cylinder and all of the control lines lead to a control switch connected with a suction-air reservoir line, whereby each individual control line is adapted to be connectd with this suction-air reservoir line by means of the control switch, after previous venting of all control lines with simultaneous closure of the suction-air reservoir line.

It becomes possible by the present invention to adjust a predetermined adjusting path step or regulating distance step without special structural expenditures. Since all of the control lines are vented with a closed suction-air reservoir line, the diaphragm piston is displaced with the aid of a spring force into a position, in which all control line connections at the working cylinder are opened. As a result of the subsequent opening of the suction-air reservoir line and the establishing of a connection between the suction-air reservoir line and a control line responsible for a selected adjusting step with simultaneous closure of the remaining control lines, the suction-air becomes effective in the suction-air working cylinder and draws the diaphragm piston against the spring force into the selected adjusting step, in which the diaphragm piston closes the opening of the control line at the working cylinder.

In an advantageous manner the control switch with its housing may be provided with a central connection for the suction-air reservoir line and with connections for the control lines arranged along a circle about the suction-air reservoir line and may include a control disk rotatable about the center longitudinal axis of the connection for the suction-air control line, which control disk is provided with a connecting channel disposed along a radius and extending between the connection for the suction-air reservoir line and a connection for a control line. It is possible by this construction to attain every desired adjusting step by a simple rotation of the control disk.

Advantageously, the housing of the control switch may be vented, and the control disk may be liftable in the axial direction against the action of a spring out of its position, in which it seals off the connections for the control lines. A rapid venting of the working cylinder by way of all the control lines is possible thereby so that the diaphragm piston can be pulled rapidly into its starting position.

In order that the lifting need not be carried out intentionally means may be provided in the housing of the control switch and at the control disk which automatically effect a temporary lifting of the control disk during the rotation of the control disk within the angular path between two adjusting path steps.

These means may consist in a structurally and functionally favorable manner of cams projecting from the control disk and located along a circle, which engage in corresponding complementary recesses in the housing of the control switch when an adjusting path step or regulating distance step is adjusted.

For closing off the connection for the suction-air reservoir line during the venting of the control lines, a valve body projecting into the connection may be arranged at the control disk, which during the lifting of the control disk, closes off the connection.

Advantageously, the valve body may be so supported at the control disk that the non-lifted control disk keeps the valve body in the open position and with a lifted control disk, a spring is able to force the valve body into the closing position.

Seals may be arranged at the control disk for a reliable closure of the connections for the control lines. Additionally, the connecting channel between the connection for the suction-air reservoir line and a connection of the control lines may be formed of sealing material at the control disk.

Accordingly, it is an object of the present invention to provide a pneumatic adjusting mechanism which avoids by simple means the aforementioned shortcomings and drawbacks encountered in the prior art.

Another object of the present invention resides in a pneumatic adjusting mechanism which obviates the need for expensive, auxiliary aggregates to establish the different steps of the adjusting path or regulating distance.

A further object of the present invention resides in a pneumatic adjusting mechanism which enables without special structural expenditures to establish a predetermined adjusting path step or regulating distance step.

Still another object of the present invention resides in a pneumatic adjusting mechanism of the type described above in which every desired adjusting path step can be obtained by a simple rotation of a control disk.

Still a further object of the present invention resides in a pneumatic adjusting mechanism of the type described above in which the diaphragm piston can be pulled rapidly into its starting position by a rapid venting of the working cylinder by way of all of its control lines.

A further object of the present invention resides in a pneumatic adjusting mechanism of the type described above which is structurally simple and operationally reliable and which does not involve expensive parts.

These and other objects, features and advantages of the present invention will become more apparent from the following description when taken in connection with the accompanying drawing which shows, for purposes of illustration only, one embodiment in accordance with the present invention, and wherein.

Figure 1:
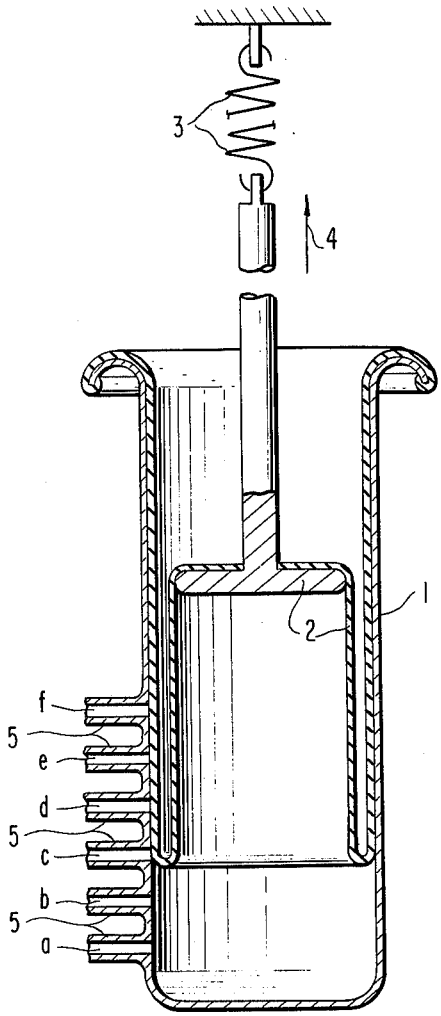
FIG. 1 is a somewhat schematic longitudinal cross-sectional view through a working cylinder with a diaphragm piston and connection of individual control lines in accordance with the present invention.

Referring now to the drawing wherein like reference numerals are used throughout the various views to designate like parts, according to FIG. 1, a diaphragm piston 2 is arranged in a working cylinder 1 constructed as servo- or adjusting motor of a pneumatic adjusting mechanism; the diaphragm piston 2 is pulled in the direction of arrow 4 by a drawspring 3. Individual connections 5 for control lines *a, b, c, d, e,* and *f* are arranged one above the other at the working cylinder 1 for establishing individual adjusting path steps or regulating distance steps.

Figure 2:
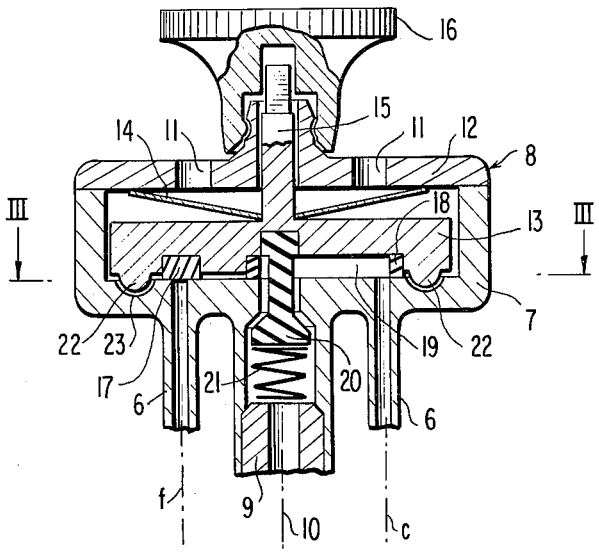
FIG. 2 is a longitudinal cross-sectional view through a control switch in accordance with the present invention with a connection to a suction-air reservoir line and with a connection of the control lines from the working cylinder.
Figure 3:
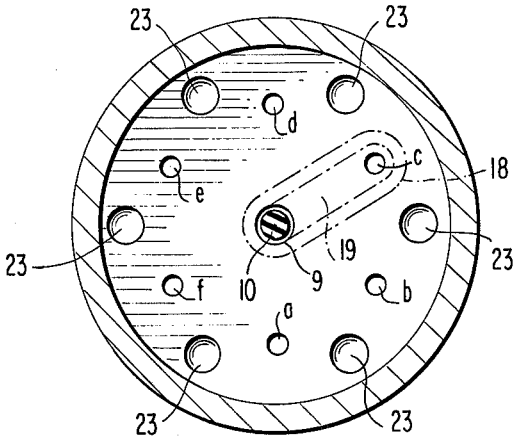
FIG. 3 is a transverse cross-sectional view through the control switch taken along line III—III of FIG. 2.

The control lines *a* to *f* lead to individual connections 6 (FIG. 2) at the housing 7 of a control switch generally designated by reference numeral 8 whereby the connections 6 are located on a circle about a central connection 9 for a suction-air reservoir line 10. A control disk 13 is disposed above the connections 6, 9 within the housing 7 which is closed off by a cover 12 provided with vent bores 11. The control disk 13 is forced in the direction toward the connections 6 and 9 by means of a spring 14. A shank or stem 15 fixed at the control disk 13 projects through the cover 12 and is provided outside of the housing 8 with a rotary knob 16.

Seals 17 supported in the control disk 13 assure for a tight closure and sealing of the connections 6 of the control lines. The arrangement is thereby made in such a manner that all connections 6 minus one connection are covered off. The remaining connection 6, in the illustrated embodiment that for the control line *c,* is connected with the connection 9 for the suction-air reservoir line 10 by way of a channel 19 sealed-off by means of a seal 18.

A valve body 20 is supported coaxially in the control disk 13, which projects through the channel 19 into the connection 9 for the suction-air reservoir line 10 and is provided thereat with a sealing cone. A compression spring 21 forces the valve body 20 in the direction toward the control disk 13.

Outside of the circle, along which the seals 17 are arranged in the control disk 13, the control disk 13 is equipped with hemispherically shaped cams 22 projecting toward the housing 7, which in the illustrated position of the control disk 13 engage in correspondingly constructed recesses 23. The cams 22 and the recesses 23 are located — in relation to the circumferential direction — respectively intermediate the connections for the control lines *a* to *f.*

In the illustrated position of the control disk 13 in the control switch 8, and of the diaphragm piston 2 in the working cylinder 1, the valve body 20 is in the open position and suction-air reaches by way of the suction-air reservoir line 10 past the valve body 20 through the channel 19 and the control line 6 up to into the working cylinder 1 where it pulls the diaphragm piston 2 against the effect of the spring 3 so far in a direction opposite the direction of arrow 4 until — as shown in FIG. 1 — the diaphragm of the diaphragm piston 2 covers off the connection 5 of the control line *c.* An adjusting path step or regulating distance step corresponding to the connection 6 of the control line *c* is adjusted for the diaphragm piston 2 and the piston rod thereof. If now another adjusting path or regulating distance step is to be adjusted, for example, an adjusting path or regulating distance step corresponding to the connection 5 of the control line *d,* then the control disk 13 is rotated by means of the rotary knob 16 in a counterclockwise direction so far until the channel 19 connects the connection 6 for the control line *d* with the suction-air reservoir line 10. During this rotary movement, the control disk 13 is temporarily lifted against the effect of the spring 14 because the cams 22 emerge out of the recesses 3. With a lifted control disk 13, the valve body 20 closes with its sealing-cone the connection 9 of the suction-air reservoir line 10 because the spring 21 presses the valve body 20 in the upward direction. The seals 17 and 18 are lifted together with the control disk 13. Atmospheric air reaches the housing 7 of the control switch 8 through the bores 11 in the cover 12 and from there, reaches all of the control lines *a* to *f* and out of the same the working cylinder 1 so that the spring 3 can pull the diaphragm piston 2 completely upwardly.

If the control disk 13 during its rotary movement has reached by means of the channel 19 the connection 6 for the control line *d,* then the cams 22 engage again in the recesses 23. The valve body 20 passes over into the open position. All control lines, except for the control line *d,* are sealed off. Suction-air now reaches from the suction-air reservoir line 10 into the channel 19, from there by way of the control line *d* into the working cylinder 1 and effects that the diaphragm piston 2 is pulled downwardly so far that the diaphragm covers off the connection 5 of the control line *d.* An adjusting path step or regulating distance step corresponding to the control line *d* is thus adjusted.

By means of the control switch 8, not only respectively adjacent adjusting path steps can be adjusted, but it is also possible to provide jumps in the adjustment of the adjusting path steps. The interior cross sections of the control lines are to be so dimensioned that a rapid venting of the working cylinder is possible.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A pneumatic adjusting mechanism, which comprises a suction-air adjusting motor including a working cylinder means having a diaphragm piston with a piston rod being acted upon by a spring against the effect of suction-air, and means for selectively adjusting different positioning steps of said adjusting motor, characterized in that individual control lines corresponding to the different steps are operatively connected at the working cylinder means, a control switch means operable to be connected with a suction-air reservoir line, all of said control lines being operatively connected with said control switch means, and further means in said control switch means operable to selectively connect each individual control line with the suction-air reservoir line, characterized in that the control switch means includes a housing means having a substantially central connection for the suction-air reservoir line and connections arranged thereabout substantially along a circle for the individual control lines, and a control disk means rotatable about the center longitudinal axis of the connection for the suction-air reservoir line, said control disk means being provided with a connecting channel between the connection for the suction-air reservoir line and a connection for a control line, characterized in that the housing means of the control switch means is vented and the control disk means is adapted to be lifted against the action of a spring in the axial direction out of its position sealing off the connections for the control lines, characterized in that actuating means are provided in the housing means of the control switch means and at the control disk means, which effect a temporary lifting of the control disk means during rotation of the control disk means within the angular path between two adjusting path steps, and characterized in that said actuating means include cam means located along a circle and projecting from the control disk means which, with an engaged adjusting path step, engage in corresponding recess means provided in the housing means of the control switch means.

2. An adjusting mechanism according to claim 1, characterized in that a valve means is arranged at the control disk means for closing off the connection for the suction-air reservoir line, said valve means projecting into said connection and closing off the connection during lifting of the control disk means.

3. An adjusting mechanism according to claim 2, characterized in that the valve means is so supported at the control disk means that the non-lifted control disk means keeps the valve means in the open position and a spring is able to force the valve means into the closing position when the control disk means is lifted.

4. An adjusting mechanism according to claim 3, characterized in that seal means for closing off the connection for the control lines are arranged at the control disk means.

5. An adjusting mechanism according to claim 3, characterized in that the connecting channel between the connection for the suction-air reservoir line and a connection of the control lines at the control disk means is formed of sealing material.

6. A pneumatic adjusting mechanism according to claim 3, characterized in that said further means includes means for connecting an individual control line with the suction-air reservoir line connection after prior venting of all control lines with simultaneous closure of the suction-air reservoir.

7. A pneumatic adjusting mechanism, which comprises a suction-air adjusting motor including a working cylinder means having a diaphragm piston with a piston rod being acted upon by a spring against the effect of suction-air, and means for selectively adjusting different positioning steps of said adjusting motor, characterized in that individual control lines corresponding to the different steps are operatively connected at the working cylinder means, a control switch means operable to be connected with a suction-air reservoir line, all of said control lines being operatively connected with said control switch means, and further means in said control switch means operable to selectively connect each individual control line with the suction-air reservoir line, characterized in that the control switch means includes a housing means having a substantially central connection for the suction-air reservoir line and connections arranged thereabout substantially along a circle for the individual control lines, and a control disk means rotatable about the center longitudinal axis of the connection for the suction-air reservoir line, said control disk means being provided with a connecting channel between the connection for the suction-air reservoir line and a connection for a control line, characterized in that actuating means are provided in the housing means of the control switch means and at the control disk means, which effect a temporary lifting of the control disk means during rotation of the control disk means within the angular path between two adjusting path steps, and characterized in that said actuating means include cam means located along a circle and projecting from the control disk means which, with an engaged adjusting path step, engage in corresponding recess means provided in the housing means of the control switch means.

8. A pneumatic adjusting mechanism, which comrises a suction-air adjusting motor including a working cylinder means having a diaphragm piston with a piston rod being acted upon by a spring against the effect of suction-air, and means for selectively adjusting different positioning steps of said adjusting motor, characterized in that individual control lines corresponding to the different steps are operatively connected at the working cylinder means, a control switch means operable to be connected with a suction-air reservoir line, all of said control lines being operatively connected with said control switch means, and further means in said control switch means operable to selectively connect each individual control line with the suction-air reservoir line, characterized in that the control switch means includes a housing means having a substantially central connection for the suction-air reservoir line and connections arranged thereabout substantially along a circle for the individual control lines, and a control disk means rotatable about the center longitudinal axis of the connection for the suction-air reservoir line, said control disk means being provided with a connecting channel between the connection for the suction-air reservoir line and a connection for a control line, characterized in that a valve means is arranged at the control disk means for closing off the connection for the suction-air reservoir line, said valve means projecting into said connection and closing off the connection during lifting of the control disk means, and characterized in that the valve means is so supported at the control disk means that the non-lifted control disk means keeps the valve means in the open position and a spring is able to force the valve means into the closing position when the control disk means is lifted.

9. A pneumatic adjusting mechanism which comprises a suction-air adjusting motor including a working cylinder means, a diaphragm piston with a piston rod, and spring means for acting on said piston through said piston rod, means for selectively adjusting different positioning steps of said adjusting motor including individual control lines communicating with said working cylinder means, and control means including control disk means for selectively communicating said individual control lines to a suction-air source line, the improvement comprising said control disk means including first means for automatically venting all of said individual control lines, and second means for closing said suction-air source line simultaneously with said venting by said first means, wherein said control means includes a housing including a first bottom plate in which said individual control lines and said suction-air source line are connected, and a second upper plate having apertures providing vent openings, said control disk means being mounted for rotation at said first bottom plate for selectively communicating respective individual control lines with said suction-air source line, wherein said first means include cam means for displacing said control disk means from said first bottom plate upon rotating said control disk means from a position communicating one of said individual control lines with said suction-air source line, such that all of said individual control lines are communicated with said vent openings, and wherein said second means includes valve means for automatically closing said suction-air source line upon rotating said control disk means from said position.

10. A pneumatic adjusting mechanism according to claim 9, wherein said suction-air source line is connected to said first bottom plate coaxially with the axis of rotation of said control disk means and said individual control lines are connected to said first bottom plate at a radial spacing from said axis, and wherein said control disk means includes a radial channel extending between said one of said individual control lines and said suction-air source line.

11. A pneumatic adjusting mechanism according to claim 10 wherein said control disk means includes seal means for sealing said individual control lines.

12. A pneumatic adjusting mechanism according to claim 9, wherein said cam means include a plurality of projections from said control disk means, said projections engaging recesses in said first bottom plate at said position communicating one of said individual control lines to said suction-air source line, and said projections bearing on said first bottom plate to lift said control disk means away from said first bottom plate upon rotation of said control disk means from said position to disengage said projections from said recesses.

13. A pneumatic adjusting mechanism according to claim 12, wherein said valve means includes a member extending from said control disk means into said suction-air source line, said member including a conically shaped portion accommodating engagement with a valve seat within said suction-air source line, and spring means for urging said member toward said valve seat.

14. A pneumatic adjusting mechanism according to claim 13, wherein second spring means are provided in said housing for urging said control disk means toward said first bottom plate, said first and second spring means acting in opposition to one another.

15. A pneumatic adjusting mechanism according to claim 12, wherein spring means are provided in said housing for urging said control disk means toward said first bottom plate.

16. A pneumatic adjusting mechanism according to claim 9, wherein said valve means includes a member extending from said control disk means into said suction-air source line, said member including a conically shaped portion accommodating engagement with a valve seat within said suction-air source line, and spring means for urging said member toward said valve seat.

17. A pneumatic adjusting mechanism according to claim 16, wherein second spring means are provided in said housing for urging said control disk means toward said first bottom plate, said first and second spring means acting in opposition to one another.

18. A pneumatic adjusting mechanism according to claim 9, wherein spring means are provided in said housing for urging said control disk means toward said first bottom plate.

19. A pneumatic adjusting mechanism which comprises a suction-air adjusting motor including a working cylinder means, a diaphragm piston with a piston rod, and spring means for acting on said piston through said piston rod, means for selectively adjusting different positioning steps of said adjusting motor including individual control lines communicating with said working cylinder means, and control means including control disk means for selectively communicating said individual control lines to a suction-air source line, the improvement comprising said control disk means including first means for automatically venting all of said individual control lines, and second means for closing said suction-air source line simultaneously with said venting by said first means, wherein said first means includes release means for releasing said control disk means from said individual control lines, such as to vent said individual control lines, and wherein said second means includes valve means for closing said suction-air source line upon operation of said release means.

* * * * *